US008739879B2

(12) United States Patent
King

(10) Patent No.: US 8,739,879 B2
(45) Date of Patent: Jun. 3, 2014

(54) HYDROSTATICALLY POWERED FRACTURING SLIDING SLEEVE

(75) Inventor: James G. King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 232 days.

(21) Appl. No.: 13/333,540

(22) Filed: Dec. 21, 2011

(65) Prior Publication Data

US 2013/0161017 A1 Jun. 27, 2013

(51) Int. Cl.
*E21B 34/00* (2006.01)

(52) U.S. Cl.
USPC ..... 166/318; 166/332.1; 166/373; 166/383; 166/386

(58) Field of Classification Search
USPC ..... 166/318, 386, 373, 383, 332.1, 128, 166/308.1
See application file for complete search history.

(56) References Cited

U.S. PATENT DOCUMENTS 5,301,755 A 4/1994 George et al.
5,826,652 A * 10/1998 Tapp ..... 166/120
7,150,318 B2 12/2006 Freeman
7,325,617 B2 2/2008 Murray
7,552,779 B2 6/2009 Murray
2007/0272411 A1* 11/2007 Lopez De Cardenas et al. ..... 166/305.1
2010/0314133 A1* 12/2010 O'Brien ..... 166/386

FOREIGN PATENT DOCUMENTS

WO WO 2004088091 A1 * 10/2004

OTHER PUBLICATIONS

Baker Hughes Incorporated product information, "FracPoint Multi-stage Completions System: Multipoint Frac Sleeves", 2011, 1 page.
Baker Hughes Incorporated product information, "FracPoint MP Sleeve with DirectConnect Ports: Improve frac efficiency with multiple fracture initiation points per stage and minimized near wellbore tortuosity", 2011, 2 pages.
Baker Hughes Incorporated product information, "Pressure-activated Frac Sleeve", 2011, 3 pages.

* cited by examiner

*Primary Examiner* — William P Neuder
*Assistant Examiner* — Taras P Bemko
(74) *Attorney, Agent, or Firm* — Steve Rosenblatt

(57) ABSTRACT

A series of sliding sleeves is actuated by a single ball that lands on a first ball seat and shifts the ball seat. The shifting of the ball seat also allows tubing pressure to communicate to a formerly atmospheric chamber on one side of a piston integrated into the back side of the sliding sleeve. The other side of the piston remains at atmospheric pressure so that the shifting of the ball seat not only releases the ball to go to the next ball seat but also puts a net force on the sliding sleeve to shift it against a travel stop to open a port to allow fracturing, even if there is cement in the annulus around the opened port.

21 Claims, 2 Drawing Sheets

HYDROSTATICALLY POWERED FRACTURING SLIDING SLEEVE

FIELD OF THE INVENTION

The field of the invention is sliding sleeve operation at a subterranean location and more particularly operating multiple sliding sleeves with a common ball while getting a boost in the opening force from a piston exposed to higher pressure by ball seat movement that releases the ball.

BACKGROUND OF THE INVENTION

Access to a formation for fracturing is typically obtained with a series of sliding sleeves. The sleeves can come with a ball seat so that in some completions there can be as many as 40 balls of a gradually increasing diameter that need to be dropped in a specific order for opening the sleeves in a specific order going from downhole to uphole.

More recently Baker Hughes has provided sliding sleeves with articulated ball seats so that a ball can land on a seat and shift a sliding sleeve and then the seat can open to allow the ball to pass further downhole to the hole bottom or to another ball seat on another sliding sleeve. This design is called the Frac Point MP Sleeve.

Another design uses tubing pressure to shift a sleeve. Opposed and isolated atmospheric chambers are provided on the outside of the sliding sleeve. One of the atmospheric chambers has a rupture disc for access of tubing pressure at a predetermined value into one of the atmospheric chambers. When the rupture disc breaks the sliding sleeve is shifted because one of the atmospheric chambers now has tubing pressure and on the opposite side of a piston formed onto the outside of the sliding sleeve there is still atmospheric pressure. Different sleeves have different rupture disc pressure ratings and in that manner the sleeves can be shifted in a hoped for predetermined order. The risk in this system is that rupture discs sometimes have significant variability in their burst pressure so that a sleeve may shift at a time where it was not planned for it to shift.

Also related for general background on sliding sleeves are U.S. Pat. Nos. 7,325,617 and 7,552,779. U.S. Pat. No. 5,301,755 shows the use of a low pressure chamber to set off a perforating gun. U.S. Pat. No. 7,150,318 shows a tractor powered shifting tool that releases a cup seal so that when engaged to a sleeve pressure can be supplied against the open cup seal to drive the shifter and take the sliding sleeve with it.

The present invention improves on the prior designs by providing a ball seat that shifts with applied differential pressure to release the ball to go further downhole to the next ball seat and the act of shifting the ball seat opens one atmospheric chamber on one side of a piston integrated into the sliding sleeve to tubing pressure. Since the other side of the piston is still at atmospheric pressure, the sliding sleeve is moved to a travel stop by pressure differential now acting on the integrated piston associated with the sliding sleeve. The process is repeated until all the sleeves have shifted and each port opened by the sleeve shifting has been used as an access location to fracture the formation. The fracturing can take place even if there is cement outside the port opened by the shifting sleeve. These and other aspects of the invention will be more readily understood by those skilled in the art from a review of the detailed description and the associated drawings while understanding that the full scope of the invention is to be found in the appended claims.

SUMMARY OF THE INVENTION

A series of sliding sleeves is actuated by a single ball that lands on a first ball seat and shifts the ball seat. The shifting of the ball seat also allows tubing pressure to communicate to a formerly atmospheric chamber on one side of a piston integrated into the back side of the sliding sleeve. The other side of the piston remains at atmospheric pressure so that the shifting of the ball seat not only releases the ball to go to the next ball seat but also puts a net force on the sliding sleeve to shift it against a travel stop to open a port to allow fracturing, even if there is cement in the annulus around the opened port.

DETAILED DESCRIPTION OF THE PREFERRED EMBODIMENT

Figure 1:
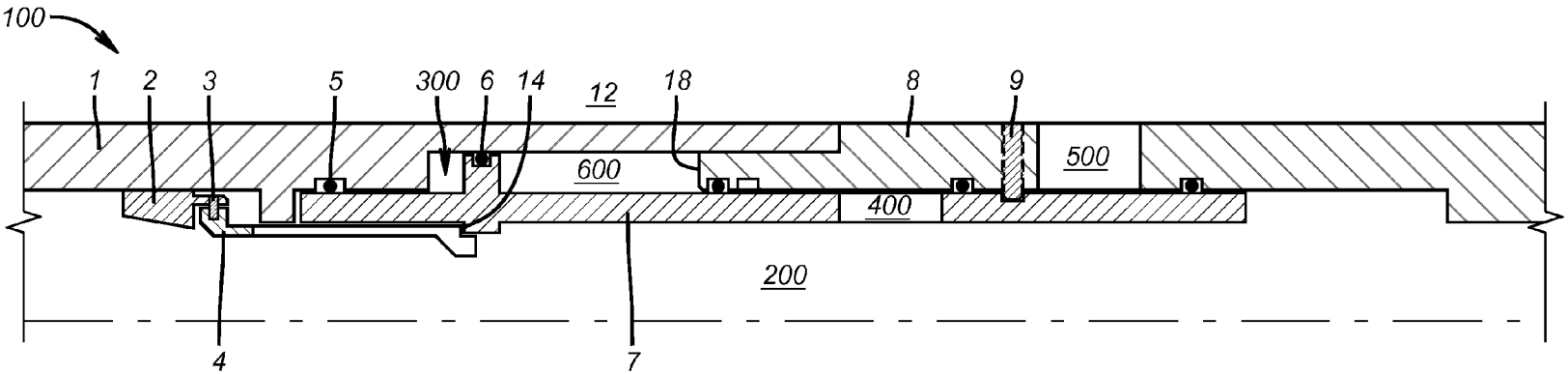
FIG. 1 is a section view of the tool in the run in position.
Figure 2:
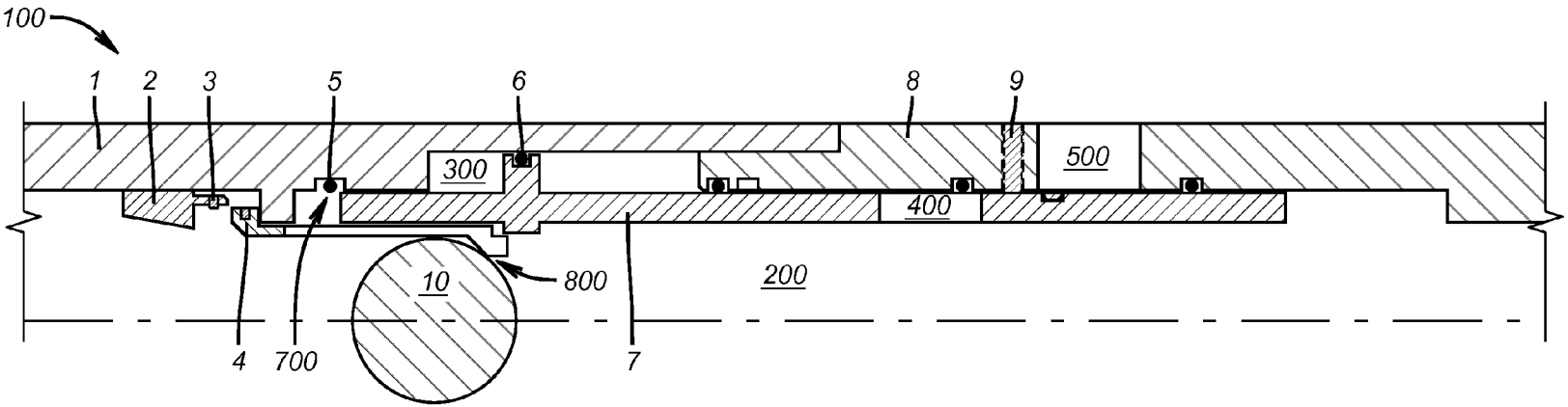
FIG. 2 is the view of FIG. 1 in the ball landed on the seat position at the onset of shifting that releases the boost force.
Figure 3:
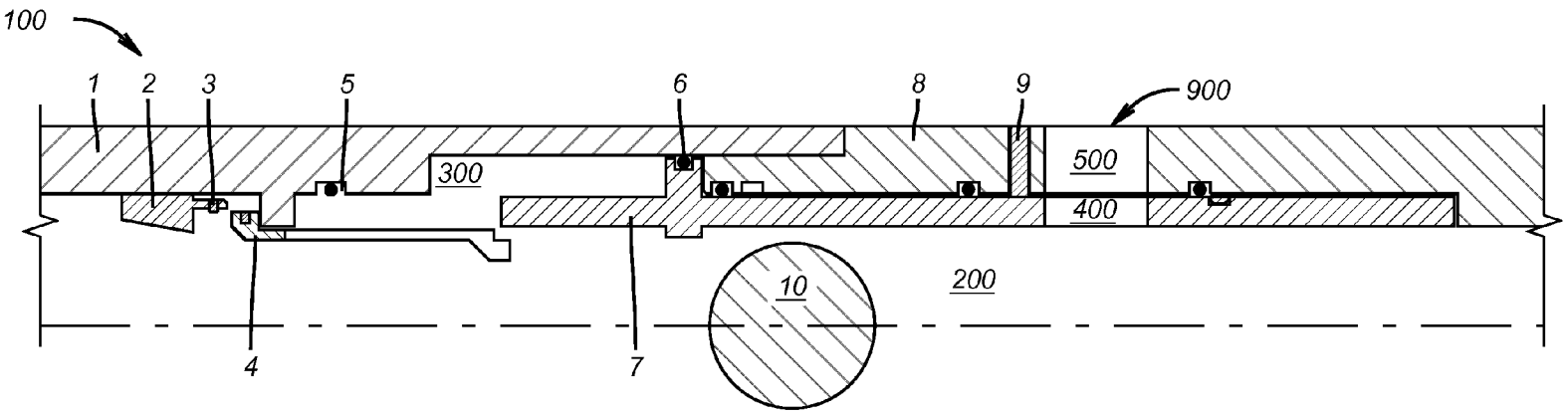
FIG. 3 is the view of FIG. 2 with the sleeve shifted with the boost force.
Figure 4:
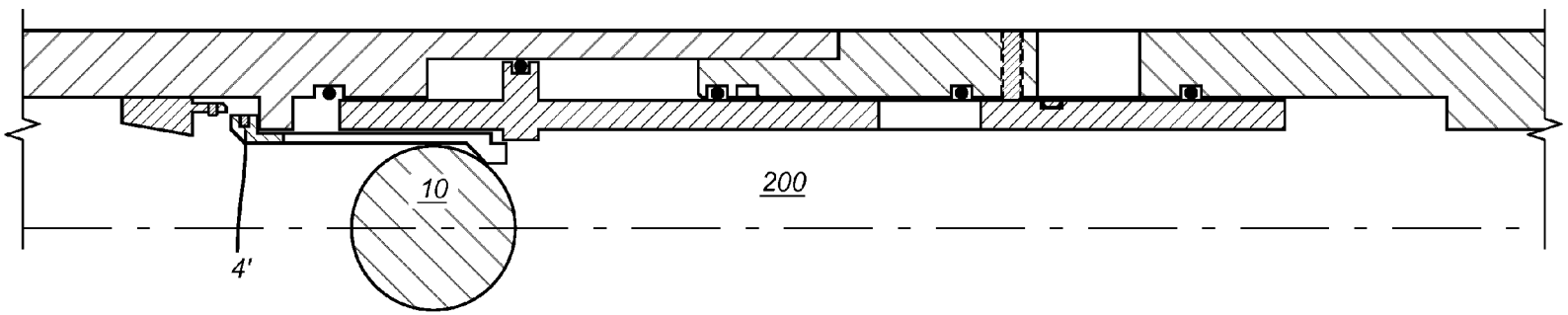
FIG. 4 is a continuation below FIG. 3 showing the object having moved through the seat above and approaching the next seat further in the hole as shown in FIG. 1.

The tool run in hole in the closed position with ports 400 offset from ports 500 in the housing 1, 8. Two atmospheric chambers, 300 and 600, as shown in FIG. 1, are in pressure balance for running in. The surrounding annulus 12 can be cemented once the tool with a plurality of sleeve inserts or sliding sleeves 7 is properly placed at the desired subterranean location. Ball 10 is then dropped and lands on the collet 4, on ball seat profile 800, as shown in FIG. 2. Collet 4 moves down shearing shear screw 3. Collet 4 moves down and fully engages with sleeve insert 7 at 14. Collet 4 and sleeve insert 7 move down in tandem initially breaking shear screw 9. Collet 4 and sleeve insert 7 move down more and unload o-ring 5, opening flood path 700 into what was atmospheric chamber 300. Fluid from the tool inside diameter 200 floods atmospheric chamber 300 through flood path 700. Atmospheric chamber 600 contracts under influence of hydrostatic pressure and tubing pressure in now open chamber 300 acting on a piston area defined by a cross sectional area from o-ring 6 to o-ring 5 and in FIG. 3 the sleeve 7 opens. Frac fluid path 900 is open as openings 400 move into alignment with openings 500 in the housing 8. Ball 10 passes downhole to next sleeve because the movement of sleeve 7 has removed support for the ball seat 800 to allow the fingers that comprise the ball seat 800 to move out radially and circumferentially away from each other so that the ball 10 can get past. After opening all sleeves, the ball 10 lands on a hard seat (not shown) to isolate lower stages in well. When all sleeves are open frac pressure passes through frac fluid path 900 in multiple sleeves to complete the frac job.

An alternative, but preferred, embodiment allows initial movement of collet 4 to directly open atmospheric chamber 300 to flooding, without first translating the sleeve insert 7. This is accomplished by allowing the collet 4 to move a predetermined amount before contact with the sleeve 7. FIG. 1 schematically shows a gap to suggest how this actuation mode can be accomplished. The same boost force occurs on sleeve 7 urging it to a travel stop at radial surface 18 on housing 8.

Those skilled in the art will appreciate that the same ball or object can trigger multiple sleeves to open in sequence to fracture in an order from closest to the surface to furthest downhole. This is accompanied by providing a boost force to each sleeve and that can be accomplished by initial sleeve movement initiated by ball seat movement or the initial ball seat movement can itself be the force that initiates the application of the boost force. The boost force occurs by allowing tubing pressure to enter what was before an atmospheric chamber that becomes open to tubing pressure due to the movement of the sleeve past a seal so as to create a pressure imbalance on one side of a piston associated with the exterior of a sliding sleeve. The differential pressure that is then applied is used to shift the sleeve in conjunction with an initial force of the ball seat hitting the sleeve due to pressure on the seated ball that breaks a shear pin to allow the sleeve to start moving. Variations are contemplated such as providing access to an atmospheric chamber through the annulus although this is less desirable since wall openings to the annulus from the tubing side are not generally preferred. To achieve this alternative the annulus can be accessed with a rupture disc that pressurizes one of the atmospheric chambers while sleeve movement still retains that formerly atmospheric chamber isolated from the tubing side. Again the disadvantage is that one seal is the only barrier between tubing pressure and annulus pressure. While the object dropped onto the ball seat can be a sphere, it can also have other shapes such as a plug or a dart to name a few examples. The criterion is to block the flow enough to get a needed pressure differential to force the seat assembly to break a shear pin or some other frangible retainer and start moving.

The above description is illustrative of the preferred embodiment and many modifications may be made by those skilled in the art without departing from the invention whose scope is to be determined from the literal and equivalent scope of the claims below:

I claim:

1. A completion assembly for subterranean use, comprising:

a tubular housing having a plurality of axially spaced ports each associated with a sliding sleeve valve such that said sliding sleeve valves are axially spaced from each other;

said sliding sleeve valves further comprising a movable seat responsive to a fluid pressure to a predetermined value on an object that sequentially lands on said seats;

individual movement of one of said movable seats redirects at least a portion of said fluid pressure to release a boost force to act on a respective said sliding sleeve valve associated with said moving movable seat, to shift said associated sliding sleeve valve and release the object to the adjacent said seat that has yet to shift.

2. The assembly of claim 1, wherein:

said sliding sleeve valves defining a piston disposed in an annular space between said housing and said sliding sleeve valve that is subjected to a pressure imbalance to provide said boost force.

3. The assembly of claim 2, wherein:

said pressure imbalance derives from access of tubing pressure in said housing to said piston.

4. The assembly of claim 3, wherein:

said access of tubing pressure to said piston results from movement of said seat.

5. The assembly of claim 4, wherein:

said access of tubing pressure to said piston results from movement of said sliding sleeve valve.

6. A completion assembly for subterranean use, comprising:

a tubular housing having a plurality of axially spaced ports each associated with a sliding sleeve valve such that said sliding sleeve valves are axially spaced from each other;

said sliding sleeve valves further comprising a movable seat responsive to a fluid pressure to a predetermined value on an object that sequentially lands on said seats;

individual movement of one of said movable seats redirects at least a portion of said fluid pressure to release a boost force to act on a respective said sliding sleeve valve associated with said moving movable seat, to shift said associated sliding sleeve valve and release the object to the adjacent said seat that has yet to shift;

said sliding sleeve valves defining a piston disposed in an annular space between said housing and said sliding sleeve valve that is subjected to a pressure imbalance to provide said boost force;

said pressure imbalance derives from access of tubing pressure in said housing to said piston;

said access of tubing pressure to said piston results from movement of said seat;

said piston defines opposed low pressure chambers;

movement of a respective said sliding sleeve valve opens one of said chambers associated with said respective sliding sleeve valve to pressure in said tubing.

7. The assembly of claim 6, wherein:

movement of a respective said sliding sleeve valve initiates a gap to pressure in said tubing due to relative movement between a seal and said respective sliding sleeve valve.

8. The assembly of claim 7 wherein:

movement of a respective said sliding sleeve valve allows a respective said seat to move radially outward toward said housing to allow the object to pass.

9. The assembly of claim 8, wherein:

movement of a respective said sliding sleeve aligns a port on said respective sliding sleeve with a port on said housing.

10. The assembly of claim 9, wherein:

movement of a respective one of said seats breaks at least one first shear pin;

movement of a respective one of said sliding sleeves breaks at least one second shear pin.

11. The assembly of claim 10, wherein:

said first shear pin breaks before said second shear pin.

12. The assembly of claim 6, wherein:

said chamber that is exposed to tubing pressure grows in volume while another chamber on the opposed side of said piston shrinks in volume.

13. The assembly of claim 12, wherein:

pressure on said piston from exposure to tubing pressure is enhanced by raising the tubing pressure after said exposure.

14. A completion assembly for subterranean use, comprising:

a tubular housing having a plurality of axially spaced ports each associated with a sliding sleeve valve such that said sliding sleeve valves are axially spaced from each other;

said sliding sleeve valves further comprising a movable seat responsive to a fluid pressure to a predetermined value on an object that sequentially lands on said seats;

individual movement of one of said movable seats redirects at least a portion of said fluid pressure to release a boost force to act on a respective said sliding sleeve valve associated with said moving movable seat, to shift said associated sliding sleeve valve and release the object to the adjacent said seat that has yet to shift;

said sliding sleeve valves defining a piston disposed in an annular space between said housing and said sliding sleeve valve that is subjected to a pressure imbalance to provide said boost force;

said pressure imbalance derives from access of tubing pressure in said housing to said piston;

said access of tubing pressure to said piston results from movement of said sliding sleeve valve;

said piston defines opposed low pressure chambers;

movement of a respective one of said sliding sleeve valve opens one of said chambers associated with said piston to pressure in said tubing.

15. The assembly of claim 14, wherein:

movement of a respective said sliding sleeve valve initiates a gap to pressure in said tubing due to relative movement between a seal and said respective sliding sleeve valve.

16. The assembly of claim 15 wherein:

movement of a respective said sliding sleeve valve allows a respective said seat to move radially outward toward said housing to allow the object to pass.

17. The assembly of claim 16, wherein:

movement of a respective said sliding sleeve aligns a port on said respective sliding sleeve with a port on said housing.

18. The assembly of claim 17, wherein:

movement of a respective one of said seats breaks at least one first shear pin;

movement of a respective one of said sliding sleeves breaks at least one second shear pin.

19. The assembly of claim 18, wherein:

said first shear pin breaks before said second shear pin.

20. The assembly of claim 14, wherein:

said chamber that is exposed to tubing pressure grows in volume while another chamber on the opposed side of said piston shrinks in volume.

21. The assembly of claim 20, wherein:

pressure on said piston from exposure to tubing pressure is enhanced by raising the tubing pressure after said exposure.

* * * * *